United States Patent [19]

Marcum

[11] Patent Number: 4,469,276

[45] Date of Patent: Sep. 4, 1984

[54] HEAT RECOVERY APPARATUS

[76] Inventor: Al Marcum, 3012 Cedar Point Rd., Crestwood, Ky. 40014

[21] Appl. No.: 429,211

[22] Filed: Sep. 30, 1982

[51] Int. Cl.[3] ..... F24B 1/18

[52] U.S. Cl. ..... 237/51; 126/121; 165/DIG. 2

[58] Field of Search ..... 126/121, 132, 101; 237/51, 55, 50; 165/DIG. 2; 122/20 B

[56] References Cited

U.S. PATENT DOCUMENTS 2,524,843 10/1950 Slifer et al. ..... 237/55

4,043,313 8/1977 Sherman ..... 126/121

*Primary Examiner*—Albert J. Makay

*Assistant Examiner*—Henry Bennett

*Attorney, Agent, or Firm*—Edward M. Steutermann

[57] ABSTRACT

The present invention discloses a heat recovery apparatus, for example for use in a fireplace having a firebox with an upwardly directed flue of selected peripheral configuration communicating with the firebox and having an atmospheric outlet. The apparatus includes units to be inserted or otherwise received and contained in the flue and having first heat conductive conduit means of selected cross section to extend generally the length of the flue in parallel spaced relation from one side of the flue, generally upwardly extending heat conductive smoke conduit in parallel spaced relation from the first conduit and communicating with the firebox and the atmosphere for emission of combustion products from the firebox, first plenum chamber means disposed at the flue outlet to seal a portion of the outlet of the flue where the smoke conduit passes through the first plenum chamber and where the first conduit communicates with the first plenum chamber, wall means defining a second conduit and extending downwardly from the bottom of the first plenum chamber in spaced parallel relation from the first conduit and defining a second annular plenum chamber surrounding the smoke conduit where the second conduit communicates with the first plenum so air can be passed through the first conduit, first plenum chamber, and second plenum chamber to a space to be heated and blower means to move or circulate a stream of air through the first conduit means and through the first and second plenum chamber, to the space to be heated.

6 Claims, 4 Drawing Figures

HEAT RECOVERY APPARATUS

BACKGROUND OF THE INVENTION

The present invention relates to the art of heating air for use in a space to be heated and more particularly provides a unit to be installed in a flue, for example in an existing or newly constructed fireplace arrangement.

Numerous prior art devices are known which relate to the general subject matter of the present invention but none teaches or anticipates the present invention.

Briefly, Silfer, et al. U.S. Pat. No. 2,524,843 teaches an arrangement where air is received in conduits and is passed downwardly adjacent a smoke conduit carrying combustion products from a firebox but does not teach an arrangement to allow double pass heating of the air to be heated where at least one pass includes heating by virtue of convective flow of combustion products pass a conduit.

Black, U.S. Pat. No. 2,277,381 teaches an arrangement utilizing multiple outlets where air is as in Silfer, passed upwardly in conductive and convective heat relation with a smoke pipe but does not provide arrangement for heating of air as specified herein.

Additionally, Jones, U.S. Pat. No. 916,519 teaches an arrangement where air is heated while it is passed upwardly through a plenum chamber to adjacent floors.

Mueller, U.S. Pat. No. 2,376,173 teaches an arrangement where the air to be heated is passed downwardly through a conduit in a flue chamber but does not teach the heating arrangement taught by the subject invention.

Frye, U.S. Pat. No. 80,719 and Elmore, U.S. Pat. No. 2,231,258 teach arrangements similar to Mueller.

Additionally, Koopmeiners, U.S. Pat. No. 4,102,319 teaches an arrangement where a plenum chamber is provided above the firebox to heat air passed therethrough and Cage, U.S. Pat. No. 790 and Sherman, U.S. Pat. No. 4,043,313 teaches an arrangement to preheat outside air for use in a combustion chamber.

Finally, Hempel, U.S. Pat. No. 4,010,728, teaches an arrangement to conduit heat around a free standing fireplace system but could not be constructed as a unit to be inserted into existing flue systems as taught by the present invention.

SUMMARY OF THE INVENTION

The present invention provides an arrangement which can be constructed as a prefabricated unit and is particularly adaptable for use in an existing fireplace system but is equally useful in a newly constructed fireplace, either of which includes an upwardly extending flue for emission of combustion products from a firebox located within the fireplace.

The present invention is particularly useful in the conversion of an existing fireplace arrangement and provides a unit which can be inserted through the top of the flue down into the firebox and can be easily connected to appropriate air inlets and outlets to communicate with the space to be heated.

Moreover devices within the scope of the present invention provide for two pass dual heating of the air to be heated. The first heating or preheating occurs in a first conduit which extends upwardly through the flue to a first, generally horizontal plenum. The second downwardly extending plenum is connected to the first plenum and communicates therewith and includes an outlet for heated air communicating with the space to be heated. A smoke conduit is provided to communicate with the firebox for emission of combustion products and the smoke conduit is heat conductive and is located within the second plenum and extends to the atmosphere through the first plenum. The air to be heated is passed through the first conduit to the first plenum and then through the second plenum where the air is finally heated by contact with the smoke conduit where the temperature of the smoke conduit is higher than the temperature to which the first conduit is exposed so that the air can be preheated in the first conduit with the higher temperature smoke conduit.

In some arrangement the air in contact with the first conduit is heated by combustion products flowing by thermo syphon effect within the space surrounding the first conduit which communicates with the firebox so the combustion products from the fire travel upwardly around the portion of the first conduit and as the combustion products cool they travel downwardly to return to the fireplace so that the thermo syphon effect results in a continuous current of heated air around the first conduit and a portion of the outside walls of the first and second plenums.

Devices within the scope of the present invention further provide means for efficient recovery and use of heat which is normally stored along the length of the walls of the flue while a fire is burning and this heat can be recovered even after the fire is out.

Likewise, in arrangements within the scope of the present invention the recovery unit hangs from the top of the flue and is suspended in a constant bath of hot circulating combustion gases flowing around the unit and on the inside by the combustion gases flowing upwardly through the smoke conduit.

No prior devices are known which utilize the combined effect described above in connection with a unit to be utilized in existing fireplaces.

More particularly, the present invention provides a heat recovery apparatus, for example for use in a fireplace having a firebox with an upwardly directed flue of selected peripheral configuration communicating with the firebox and having an atmospheric outlet where the apparatus includes units to be inserted or otherwise received and contained in the flue and having first heat conductive conduit means of selected cross section to extend generally the length of the flue in parallel spaced relation from one side of the flue, generally upwardly extending heat conductive smoke conduit in parallel spaced relation from the first conduit and communicating with the firebox and the atmosphere foremission of combustion products from the firebox, first plenum chamber means disposed at the flue outlet to seal a portion of the outlet of the flue where the smoke conduit passes through the first plenum chamber and where the first conduit communicates with the first plenum chamber, wall means defining a second conduit and extending downwardly from the bottom of the first plenum chamber in spaced parallel relation from the first conduit and defining a second annular plenum chamber surrounding the smoke conduit where the second conduit communicates with the first plenum so air can be passed through the first conduit, first plenum chamber, and second plenum chamber to a space to be heated and blower means to move or circulate a stream of air through the first conduit means and through the first and second plenum chamber, to the space to be heated.

Blower means for admission of air to be heated to the passageway to find the first conduit means, first plenum means and second plenum means so that air to be heated is passed therethrough.

It will be understood that various other arrangements also within the scope of the present invention will become obvious to those skilled in the art upon reading the disclosure set forth hereinafter.

One example in accordance with the present invention is described in the accompanying figures wherein:

DETAILED DESCRIPTION OF THE DRAWINGS

Figure 1:
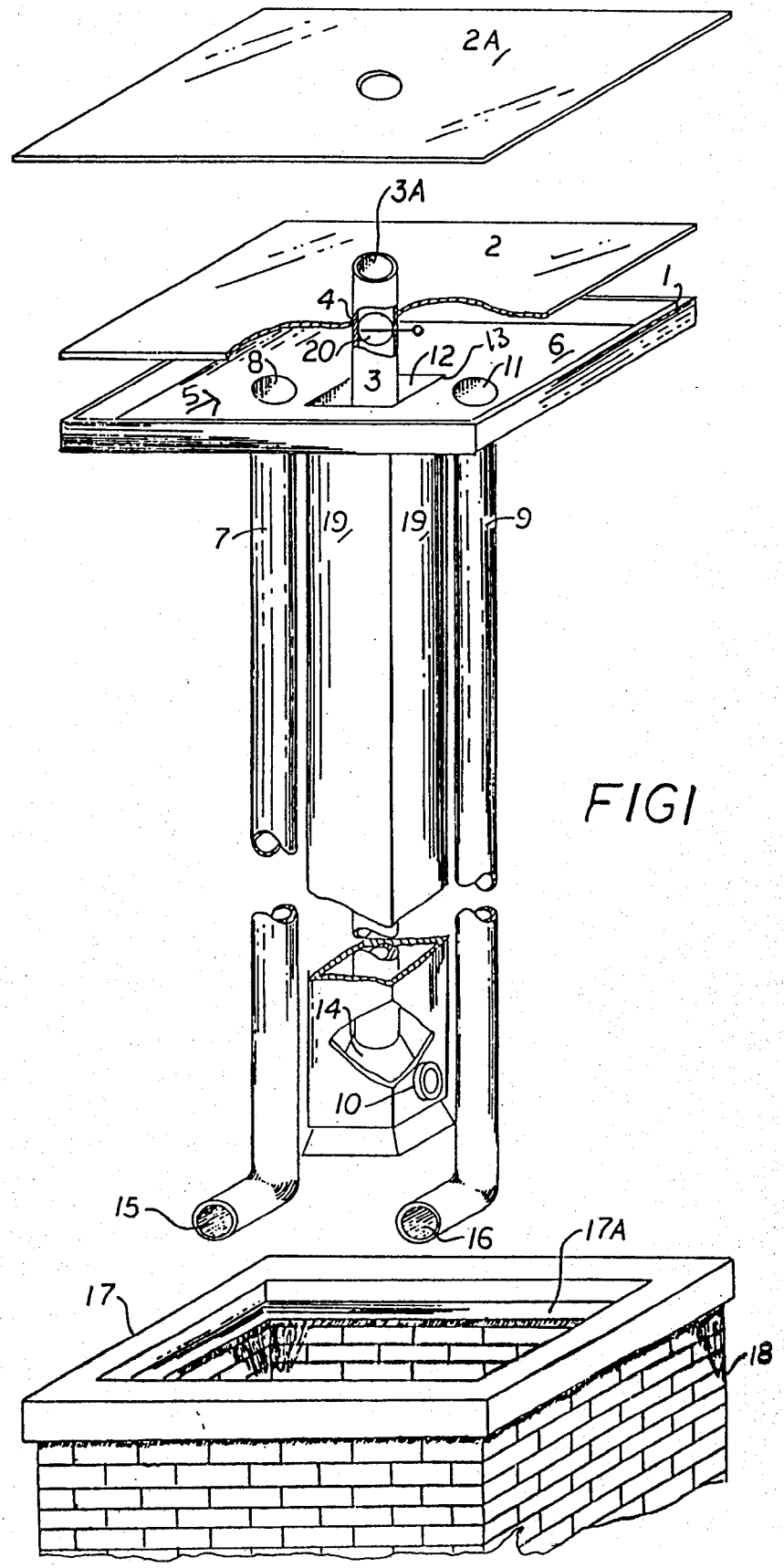
FIG. 1 is a perspective view of an example of a unit partially in section within the scope of the present invention.

Referring first to FIG. 1, the arrangement within the scope of the present invention as shown is adapted to be received in an existing flue and includes a plenum chamber 6 at the top of the unit defined by casing 1 having a top 2 and a base 5 adapted to receive a smoke conduit 3, hereinafter described, through an aperture 13 of base 5 and aperture 4 of top 2. Top 2 can be secured to the upstanding edges of casing 1 by means of fastening devices (not shown).

Accordingly, plenum chamber 6 is defined by frame 1 and base 5 with top 2 in place. The outer periphery of casing 1 can be adapted to be received and rest on the tops 17 of a chimney flue 18 or as shown, received within a recess 17A in the top of chimney 18, it being understood such an arrangement is not shown in the Figures. As described hereinafter, the entire unit is dropped downwardly through flue 18 and connected to selected area intakes and outlets as described hereinafter.

Additionally, it will be understood that devices within the scope of the present invention can include damper means (not shown) located at an outlet from conduit 3. First damper means can be utilized to increase the retention of combustion gases in the system fireplace, where the damper can be adjusted to maintain a balance and to provide additional time for recovery of heat from gases passing upwardly through the flue. Likewise, surface extension such as heat fins or corrugations (not shown), can be provided on the surfaces of smoke conduit 3 to improve heat transfer efficiency.

Further it will be recognized that the top plenum composed of base 5, top 2 and casing 1 provides support for the entire unit described hereinafter, as well as the cross-over members also described hereinafter.

As shown in the Figures, a first conduit 7 is provided to extend downwardly from an opening 8 in plenum chamber 6 and a second conduit 9 can also be provided having an inlet 11 in plenum 6.

Likewise a plenum chamber 12 is defined surrounding conduit 3 by means of walls 19 depending centrally from the base 5 of plenum 6 where wall members 19 define an opening 13 to plenum 6. Walls 19 extend downwardly from base 5 substantially the entire length of the unit so that walls 19 are heated along the length thereof by combustion gas passing upwardly on the outside of the walls. Wall members 19 terminate at a hood 14, for example, defined by pyramidal wall members received within the plenum defined by wall members 19 where smoke conduit 3 extends upwardly from the top of hood 14 communicating with the fireboxes described hereinafter. As shown, hood 14 can be a frustro pyramidal shape to facilitate flow of combustion products through smoke conduit 3 but it will be recognized that other hood type arrangements can be provided depending upon design characteristics. Additionally, hood 14 can be selectively removable from conduit 3 and conduits defined by wall members 19 to facilitate insertation of the unit in a flue or removal of the unit for cleaning. Wall members 19 are provided with an outlet 10 for emission of air heated from the annular plenum defined between wall members 19 and smoke conduit 3. It will be recognized that additional outlet openings can be provided as desired.

Conduits 7 and 9 are provided so that openings 15 and 16 which can be connected to a source of air to be heated as described hereinafter.

Figure 2:
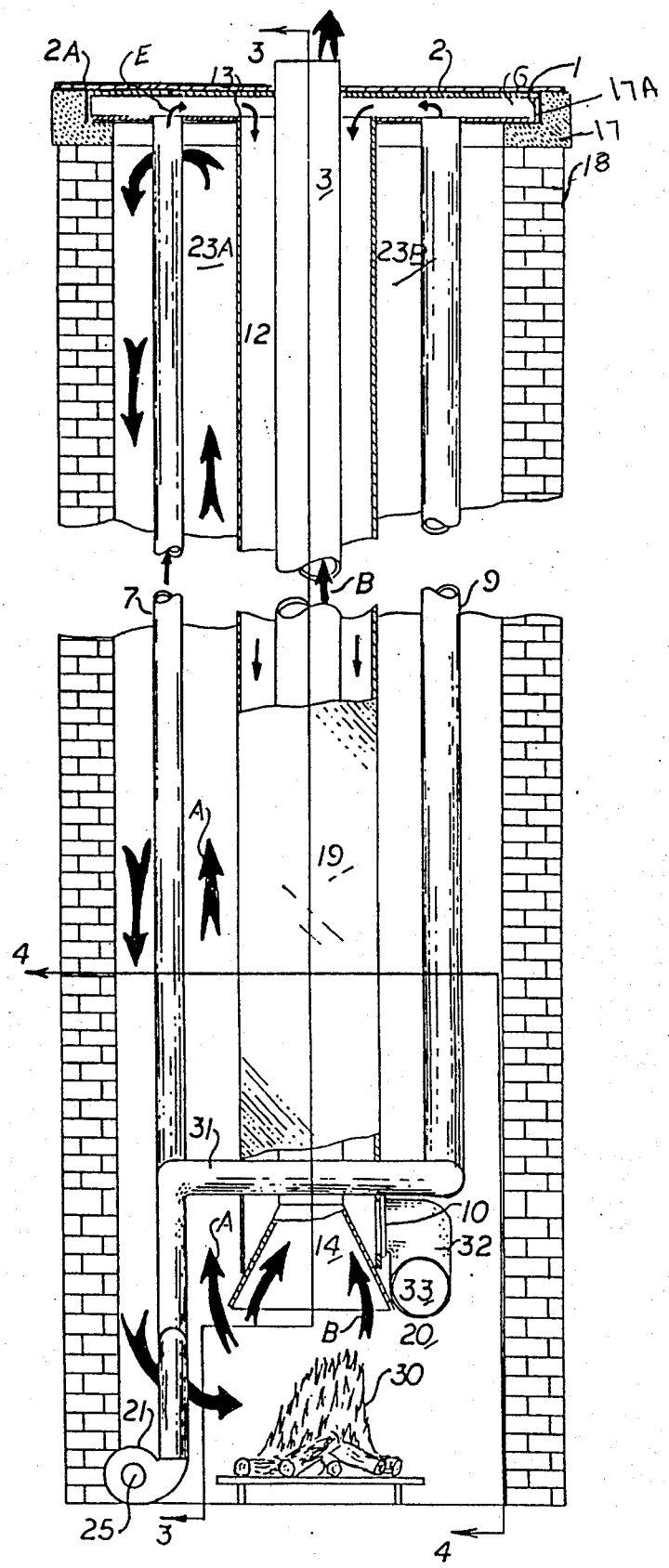
FIG. 2 is a sectioned plan view of an arrangement within the scope of the present invention in place inside a fireplace.

FIG. 2 is an illustration, in section, of the units shown in FIG. 1 in place in a fire box 25 and flue 18. The lower inlets 15 and 16 of conduits 7 and 9 are located within the firebox and can be adapted to be connected to a blower 21 provided with an inlet 25 to supply air to be heated to the unit. Blower 21 is shown adjacent the foreplace, it will be recognized, depending upon a particular application, blower 21 can be disposed at a remote location.

Figure 3:
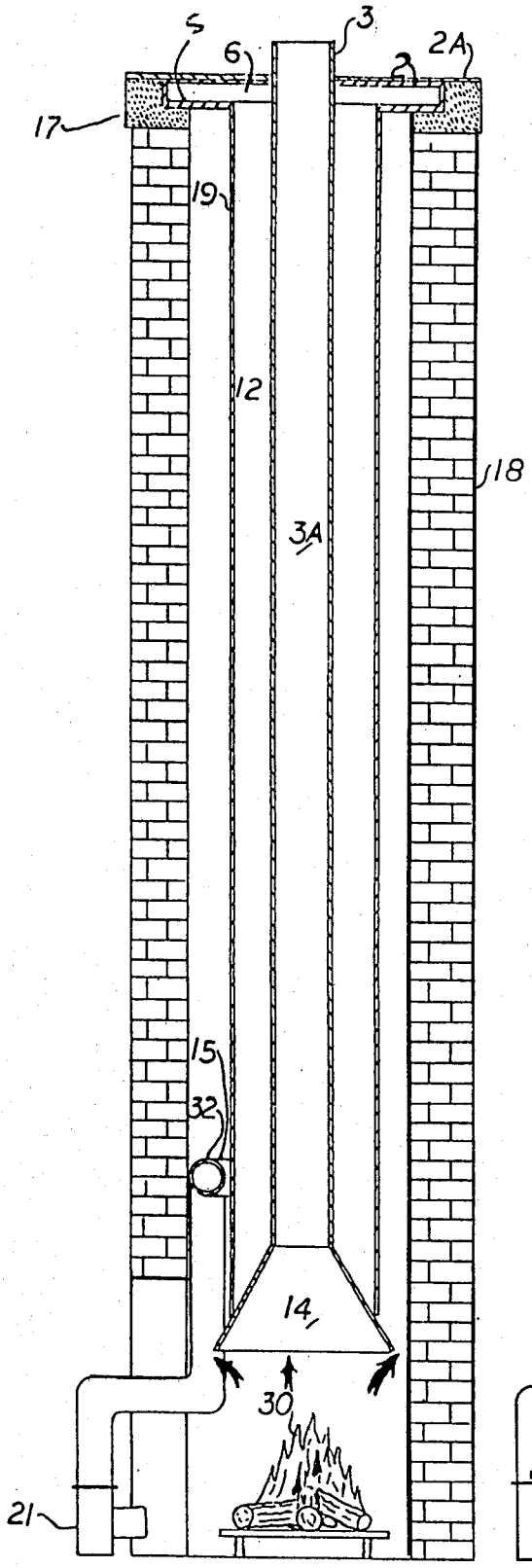
FIG. 3 is a view taken along a plane passing through line 3—3 of FIG. 2.
Figure 4:
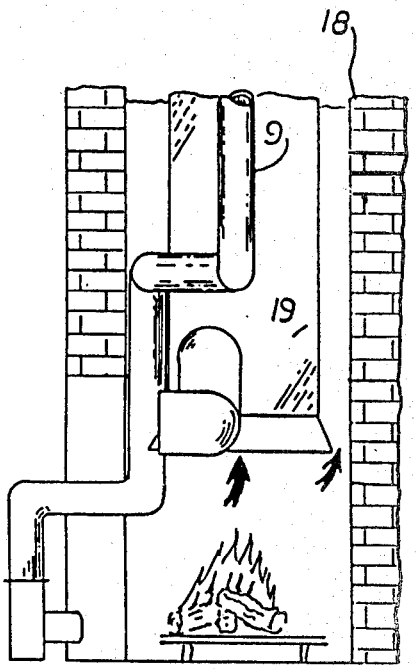
FIG. 4 is a view taken along a line 4—4 of FIG. 2.

Referring to FIG. 2 it will be noted that an area 23A can be defined generally between one side of wall 19 and the walls of flue 18 while a second such area 23B can be defined generally on the opposite sides. It will be further understood that as shown in FIG. 3 walls 19 do not necessarily extend to the sidewalls of flue 18 so the conductive heat currents are received on all of the walls 19. It is in this area of semi active hot air flow the preliminary heating of the air in conduit 7 and 9 occurs by the thermo syphon effect, a portion of which is illustrated by arrows A where hot combustion gases from fire 30 indicated by arrows A, pass outside hood 14 and upwardly, for example in chamber areas 23A or 23B to return as shown. The hot active air from fire 30 passes upwardly as indicated by arrows B through hood 14 to smoke conduit 3 and out of the conduit to the atmosphere. The air to be heated is admitted to blower 21 through inlets 25 and passes upwardly through conduits 7 and 9, where the inlets 15 and 16 are innerconnected through means of a crossover 31. Likewise, an extension 32 is provided, for heated air outlet 10 to provide an outlet 33 for emission of hot air to a space to be heated (not shown). As previously discussed, multiple outlets can be provided to various locations if desired.

In the arrangements shown the air to be heated is admitted to conduits 7 and 9 from inlet 25 of blower 21 and passes upwardly through conduits 7 and 9 located in plenum areas 23A and 23B which receives hot combustion products from fire 30 as indicated by arrows A where the combustion gases are circulated by thermo syphon flow. The initially preheated air is received in plenum 6 as shown by arrows E and flows downwardly through the second plenum chamber 12 defined by walls 19 and smoke conduit 3 for final heating before emission from outlet 10. It will be recognized that within the scope of the present invention reverse direction of air flow can be provided.

It will be further recognized that the devices within the scope of the present invention can easily be inserted in an existing fireplace and can likewise be easily removed for cleaning of depositions which may from time to time occur or for repair of the unit.

The foregoing is but one example of an arrangement within the scope of the present invention and it will be understood that while the examples shown in the Figures relate to the unit adapted to be received in a flue of rectangular cross section units within the scope of the present invention can be adapted to be received in flues of any peripheral configuration. Also, various other arrangements within the scope of the present invention will become obvious to those skilled in the art upon reading the disclosure set forth hereinbefore.

The invention claimed is:

1. A heat recovery apparatus for use in a fireplace having a firebox with an upwardly directed flue of selected peripheral cross section defined by cooperative sidewalls and communicates with said firebox and having an outlet, including:

a. first plenum chamber means to be located adjacent the top of the flue across a portion of said outlet and having a smoke conduit receiving aperture therethrough;

b. at least one first conduit means of selected cross section having a first end communicating with said first plenum chamber means and adapted to extend downwardly therefrom within said flue to said firebox and terminating in a second end.

c. second conduit means of selected mean diameter having a first end communicating with said first plenum means and extending downwardly therefrom through a portion of the length of said flue in spaced generally parallel relation from said first conduit in generally aligned relation with said smoke conduit receiving aperture of said first plenum where said second conduit includes first air flow opening means adjacent the bottom thereof and where combustion gasses are exposed to the outside of the second conduit;

d. smoke conduit means having a mean diameter less than the mean diameter of said second conduit and adapted to be received within said second conduit whereby a second annular plenum means is defined between said smoke conduit and said second conduit and wherein said smoke conduit extends through said smoke conduit receiving aperture of said first plenum with an outlet above said first plenum and an inlet in communicative relation with said firebox and where said second annular plenum and said first conduit are in communicative relation through said first plenum;

e. blower means to move air to be heated through said first conduit, said first plenum means and said second plenum means to a space to be heated; and f. wherein said second conduit is located in spaced relation from a side wall of said flue whereby a combustion gas plenum chamber is defined by a portion of the side walls of said flue and a portion of said conduit, and said first conduit is located within said combustion gas plenum chamber and said combustion gas plenum chamber communicates with said firebox so combustion products from said firebox flow by thermo syphon effect along the surface of said first conduit and along the outside walls of said first and second plenums.

2. The invention of claim 1 wherein said smoke conduit includes flare means at said smoke conduit inlet to direct gas to said smoke conduit.

3. The invention of claim 1 wherein said second conduit is located in spaced relation from a side wall of said flue whereby a third plenum chamber is defined by a portion of the sidewalls of said flue and a portion f said conduit, and said first conduit is located within said third plenum chamber and said third plenum chamber communicates with said firebox so combustion products from said firebox flow by thermo syphon effect along the surface of said first conduit and along outside walls of said first and second plenums.

4. The invention of claim 2 wherein said second conduit is of generally square cross section and said flare means is of generally frustro pyramidal shape and said smoke conduit communicates with the apex of said frustro pyramidal flare.

5. The invention of claim 1 wherein said flue is of generally rectangular cross-section, where said second conduit is generally centrally located to defined first and second plenums on either side thereof and where said first conduit means maybe provided on each side of said second conduit.

6. The invention of claim 1 wherein air to be heated flows first to said first conduit means, then to said first plenum and then to said second conduit and then to said space to be heated.

* * * * *